US010112206B2

(12) United States Patent
Espinoza

(10) Patent No.: US 10,112,206 B2
(45) Date of Patent: Oct. 30, 2018

(54) PUMP SYSTEMS, PUMP ENGINES, AND METHODS OF MAKING THE SAME

(71) Applicant: WestRock Dispensing Systems, Inc., Norcross, GA (US)

(72) Inventor: Alejandro Espinoza, Overland Park, KS (US)

(73) Assignee: SILGAN DISPENSING SYSTEMS CORPORATION, Grandview, MO (US)

( * ) Notice: Subject to any disclaimer, the term of this patent is extended or adjusted under 35 U.S.C. 154(b) by 0 days.

(21) Appl. No.: 15/297,668

(22) Filed: Oct. 19, 2016

(65) Prior Publication Data

US 2017/0197227 A1 Jul. 13, 2017

Related U.S. Application Data

(63) Continuation-in-part of application No. 14/991,131, filed on Jan. 8, 2016.

(51) Int. Cl.

| | |
|---|---|
| ***B67D 7/58*** | (2010.01) |
| ***B05B 11/00*** | (2006.01) |
| ***F04B 53/16*** | (2006.01) |
| ***F04B 53/14*** | (2006.01) |
| ***F04B 53/10*** | (2006.01) |
| ***F04B 23/02*** | (2006.01) |
| ***F04B 19/22*** | (2006.01) |

(52) U.S. Cl.

CPC ..... *B05B 11/3001* (2013.01); *B05B 11/0089* (2013.01); *B05B 11/3047* (2013.01); *F04B 19/22* (2013.01); *F04B 23/028* (2013.01); *F04B 53/1087* (2013.01); *F04B 53/144* (2013.01); *F04B 53/162* (2013.01)

(58) Field of Classification Search

CPC ..... B05B 11/3007; B05B 11/3008; B05B 11/0031; B05B 11/0089; B05B 11/3047; B05B 11/3001; F04B 9/14; F04B 53/162; F04B 53/144; F04B 53/1087; F04B 23/028; F04B 19/22

USPC ..... 222/321.7–321.9, 321.1–321.3, 320, 222/383.1

See application file for complete search history.

(56) References Cited

U.S. PATENT DOCUMENTS

| | | | | |
|---|---|---|---|---|
| 3,187,960 | A * | 6/1965 | Gorman | B05B 11/3023 222/321.9 |
| 2008/0035678 | A1* | 2/2008 | Lee | B05B 11/3023 222/320 |
| 2008/0210713 | A1* | 9/2008 | Langlois | B05B 11/3007 222/321.9 |
| 2012/0267399 | A1* | 10/2012 | Moretti | B05B 11/3008 222/321.2 |
| 2015/0060484 | A1* | 3/2015 | Byun | B05B 1/00 222/39 |

* cited by examiner

*Primary Examiner* — Lien Ngo
(74) *Attorney, Agent, or Firm* — Barlow, Josephs & Holmes, Ltd.

(57) ABSTRACT

A pump engine assembly includes an output cylinder that may be customized to include a stop portion limiting the stroke of a piston to produce a particular output such that customized pump systems may be produced from similar parts with the exchange of only a single part—the output cylinder, and wherein movement of a fluid lock in a product chamber creates a suck-back feature capable of pulling product away from a dispensing head opening.

7 Claims, 9 Drawing Sheets

PUMP SYSTEMS, PUMP ENGINES, AND METHODS OF MAKING THE SAME

CROSS-REFERENCE TO RELATED APPLICATIONS

This application is a continuation-in-part of, and claims the benefit of, U.S. patent application Ser. No. 14/991,131, entitled "PUMP SYSTEMS, PUMP ENGINES, AND METHODS OF MAKING THE SAME," filed 8 Jan. 2016, and incorporates the same herein by reference in its entirety.

BACKGROUND OF THE INVENTION

Field of the Invention

Embodiments of the invention relate to pumps systems and engines used to assemble such pump systems, including pump engines having adjustable outputs and interchangeable parts for creating different outputs.

State of the Art

Pumps and pump systems are frequently used to dispense flowable products, including personal and beauty care products. For example, makeup, lotions, creams, and other beauty care products are frequently packaged with a pump to facilitate the dispensing of the product, to control the dose of the product, or both. In addition, some brands will offer a complete line of products to be used together. Often times, the brand-owner desires to maintain a common brand image across the branded product offerings, requiring similar looking pumps and pump systems having different outputs. While pumps and pump systems having the same aesthetics but different dosing capabilities may be made, such pump systems often require completely different parts or pump engines associated with the aesthetics to produce different dosage capabilities. Thus, to have a family of similar looking pump systems with different dosage capabilities, it is often necessary to manufacture several different pump systems or pump engines, each of which have multiple parts. In order to make all of the parts, multiple tools are required to produce the parts for each size—or dosage—of pump system. The increased capital for such duplicative parts can be costly.

To reduce costs, some manufactures may provide a standard closure and pump head and then attach different pump engines thereto, wherein each of the pump engines provides a different output. In this manner, a common aesthetic look may be provided while offering different outputs for the various branded products. Typically, each of the pump engines may include an accumulator, a spring, and a piston system consisting of a piston stem and a piston seal. For different engines, each of the parts is a different size. Thus, for a first output, the accumulator, piston stem, and piston seal will have a first size and for a second output they will have a second, different size. Tools or molds for each size of component are used to manufacture the components and often times different assembly lines are required for the different engine sizes. The requirement for multiple tools and separate assembly lines increases the costs associated with making each pump.

Furthermore, in many cases brand owners are looking for smaller runs of a pump system for their niche products or for products that do not have the market share of some of their larger products. When multiple sizes are required with smaller runs for products having smaller market share, the relative costs to produce the smaller runs increases due to labor costs, changeovers in manufacturing, and other factors.

As a result of the costs associated with offering pump systems with variable output options, it may be difficult and prohibitively expensive to manufacture pump systems that may be tailored for differing outputs. Thus, a more cost-effective solution to providing pump systems and pump engines with different outputs is desirable.

BRIEF SUMMARY OF THE INVENTION

Pump systems according to some embodiments of the invention include pump engines having a single part that may be customized for a desired output such that the same tools, assembly lines, and other manufacturing processes may be used to manufacture pump systems having different outputs. For example, a pump system may include a closure attached to a container, a pump head moveable relative to the closure for pumping a pump engine and delivering a product, and a pump engine attached to the closure and in fluid communication with the pump head. The pump engine may include an accumulator, a valve for controlling flow of a product into an interior of the accumulator, a piston stem, a piston seal seated on an interior portion of the accumulator and attached to the piston stem, an output cylinder attached to the accumulator and within which a portion of the piston stem extends, and a spring acting on both the piston stem and the output cylinder. In various embodiments of the invention, the output cylinder may include one or more output stops configured to stop movement of the piston stem during the stroke of the pump system. An output cylinder may be customized with a output stop at a desired location to provide a desired dose from the pump engine. More particularly, if a first dosage is required, an output cylinder having an output stop at a first location may be assembled as part of the pump engine; if a second dose is required, an output cylinder having an output stop at a second location may be assembled as part of the pump engine. Thus, pump engines and pump systems having different dosages may be made utilizing all of the same parts except for the output cylinder which may be customized for a particular dose.

According to some embodiments of the invention, an output cylinder may include venting features providing a vent path for an assembled pump system utilizing the output cylinder. Such pump systems may be used as atmospheric pumps. In other embodiments, vent features may not be included in the pump engine such that the pump engine may be used in a pump system intended to pump product from an airless system.

According to still other embodiments of the invention, an output cylinder may be color coordinated with respect to the output capability provided by the output stop in the output cylinder. Color coordination may also be used to designate whether or not the output cylinder is a venting version or non-venting version. For example, a first output with a venting feature may be colored red, a second output with a venting feature may be colored blue and a second output without a venting feature may be colored green. The color coordination allows an operator on the manufacturing floor to quickly identify the necessary output cylinder to be used for assembly processes.

BRIEF DESCRIPTION OF THE DRAWINGS

While the specification concludes with claims particularly pointing out and distinctly claiming particular embodiments of the present invention, various embodiments of the invention can be more readily understood and appreciated by one of ordinary skill in the art from the following descriptions of various embodiments of the invention when read in conjunction with the accompanying drawings in which:

DETAILED DESCRIPTION OF THE INVENTION

Figure 1:
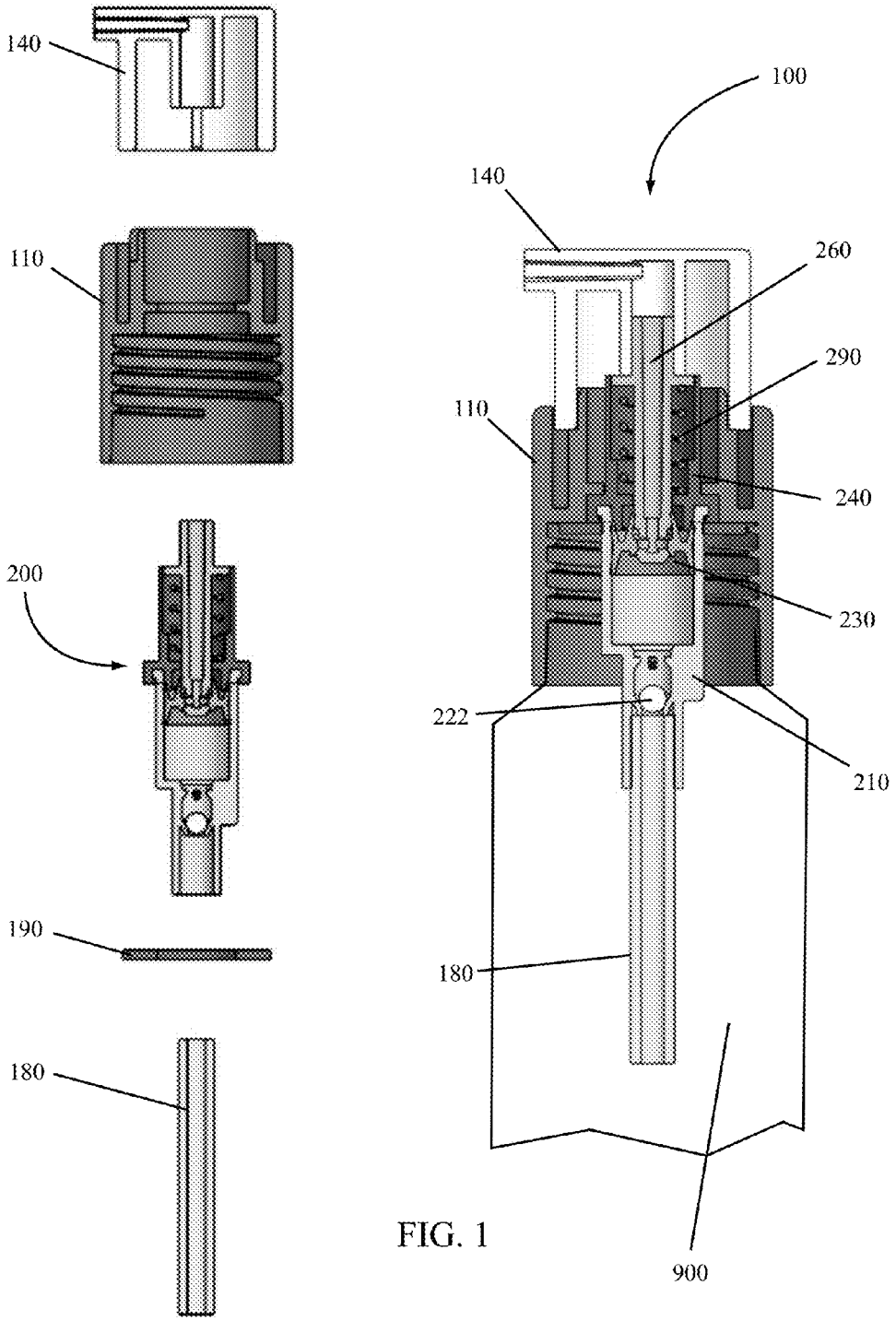
FIG. 1 illustrates a cross-sectional view of an assembled and blown-apart pump system according to various embodiments of the invention.

A pump system 100 according to various embodiments of the invention is illustrated in FIG. 1. As illustrated, a pump system 100 may include a pump engine 200—or engine assembly—attached to a closure 110 and mounted on a bottle or container 900. A head 140 may be moveably fitted to the closure 110. A gasket 190 may be positioned between the pump engine 200 or closure 110 and the container 900. In some embodiments, a tube 180 may also be fitted to the pump engine 200.

Figure 2:
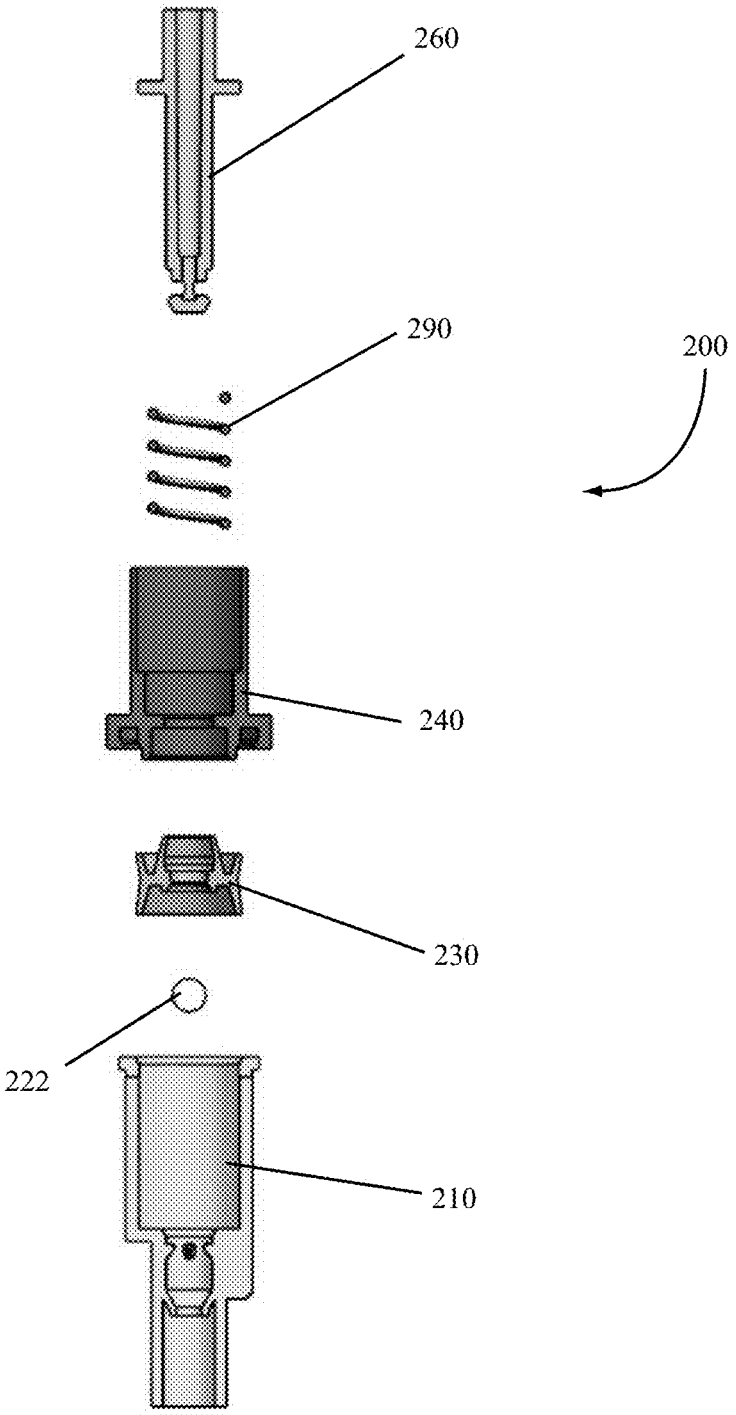
FIG. 2 illustrates a blown-apart, cross-sectional view of a pump engine assembly according to various embodiments of the invention.

A pump engine 200 that may be used with a pump system 100 according to various embodiments of the invention may include an accumulator 210, a valve 220, a piston 230, an output cylinder 240, a spring 290 and a piston stem 260 as illustrated in FIG. 2. In some embodiments of the invention, the accumulator 210, valve 220, piston seal 230, spring 290, and piston stem 260 may be conventional components.

Figure 4:
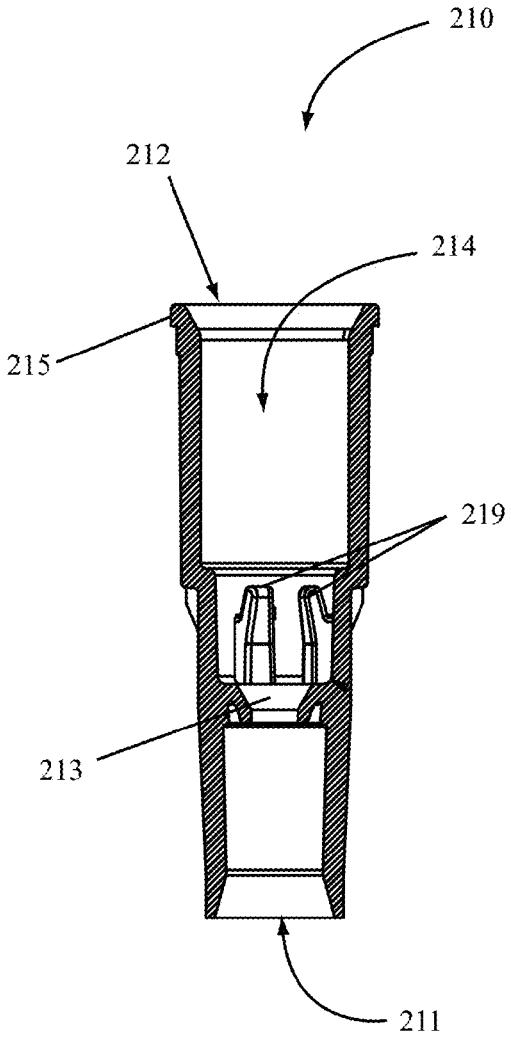
FIG. 4 illustrates a cross-sectional view of an accumulator according to various embodiments of the invention.

An accumulator 210 according to various embodiments of the invention may include a first opening 211 at one end thereof and a second opening 212 at an opposite end thereof. A valve seat 213 may be positioned between the first opening 211 and second opening 212. The valve seat 213 may include a plurality of fingers 219 as illustrated in FIG. 4 which fingers 219 may retain a ball 222 as part of the valve 220. In other embodiments, a valve seat 213 may include a seat for a moveable plug valve, flap valve, spider valve, or other type of valve. Walls of the accumulator 210 may define a product chamber 214 between the valve seat 213 and the second opening 212. The product chamber 214 may include a cylindrical shape capable of receiving a piston seal 230.

Figure 3:
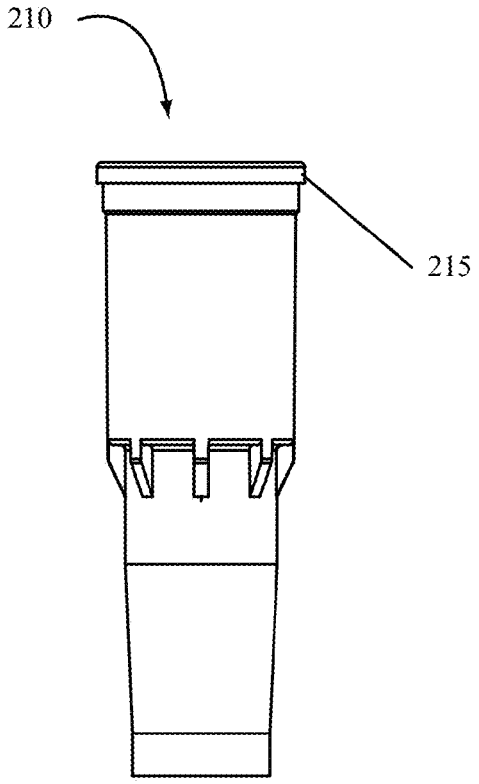
FIG. 3 illustrates an accumulator according to various embodiments of the invention.

According to some embodiments of the invention, the accumulator 210 may include a retaining ring 215 portion about a circumference of the second opening 212. For instance, in some embodiments, a retaining ring 215 may include a lip projecting outwardly from the walls of the accumulator 210 at or near the second opening 212 as illustrated in FIGS. 3 and 4. In some embodiments, the retaining ring 215 may be integrally formed with—or molded as a part of—the accumulator 210. The retaining ring 215 may snap-fit or otherwise connect with an output cylinder 240 of a pump engine 200.

In other embodiments of the invention, an accumulator 210 may include other connection features about the second opening 212 thereof. For instance, snap beads or other formations extending off of the rim of the second opening 212 may be configured to mate with another part of a pump engine 200 and to retain the accumulator 210 therewith. In other embodiments, the accumulator 210 may include a receiving channel or indentation about the rim of the second opening 212 to accept a snap-bead or other connection feature associated with another component of a pump engine 200. In still other embodiments, an accumulator 210 may include threads allowing the accumulator 210 to be screwed onto another part of a pump engine 200.

According to some embodiments of the invention a valve 220 may include a ball valve having a ball 222 retained within the accumulator 210 adjacent a valve seat 213 as illustrated in FIGS. 1 and 2. The ball 222 may be made of glass, plastic, metal, or some other material or composite. Other valves 220 and valve systems may be used with various embodiments of the invention as desired. For example, a valve 220 may include a flap valve, an umbrella valve, a duck-bill valve, or other moveable plug-type valve that can perform valving functions for a pump system 100.

Figure 5:
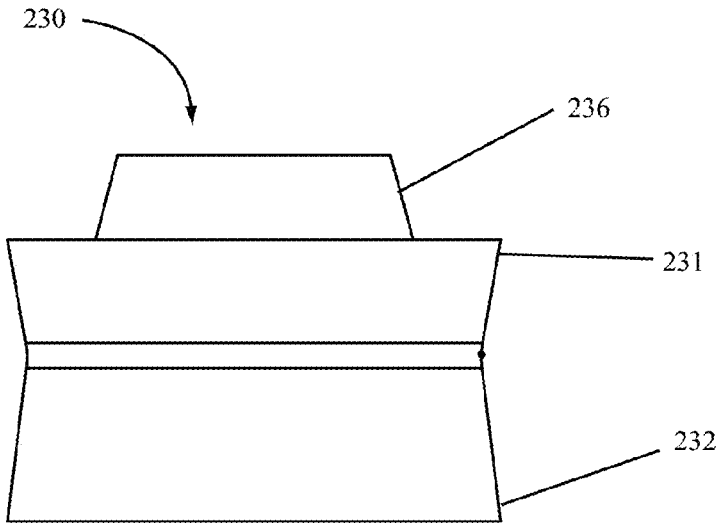
FIG. 5 illustrates a piston seal according to various embodiments of the invention.
Figure 6:
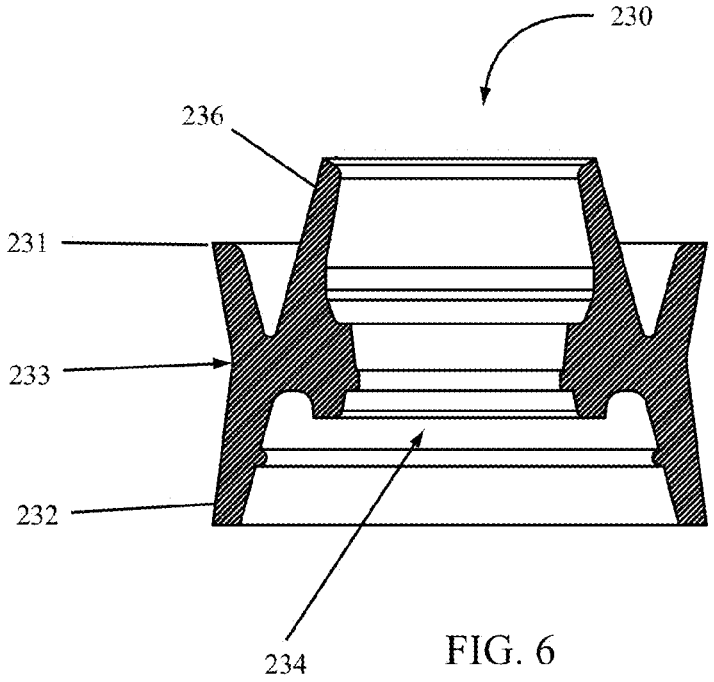
FIG. 6 illustrates a cross-sectional view of a piston seal according to various embodiments of the invention.

A piston seal 230 according to various embodiments of the invention may include a conventional piston seal 230 used with pump systems and configured to fit within and seal against the accumulator 210. In some other embodiments of the invention, a piston seal 230 may include a body having a top flange 231 and a bottom flange 232 extending outwardly from a central portion of the body as illustrated in FIGS. 5 and 6. The central portion 233 of the body may include a piston seal opening 234 configured to accept a portion of the piston stem 260. An inner flange 236 may extend upward and inward from the central portion 233 of the body and may be configured to seal against a portion of a piston stem 260.

Figure 7:
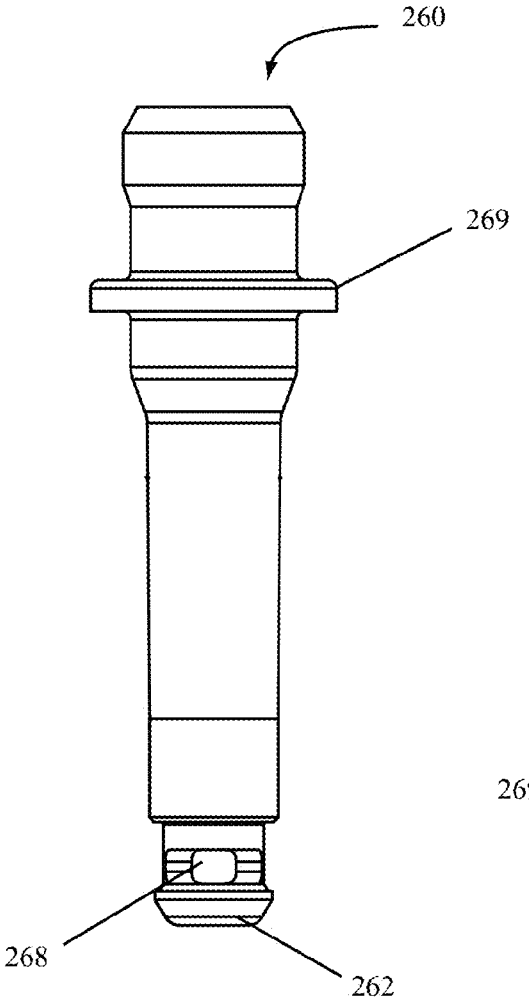
FIG. 7 illustrates a piston stem according to various embodiments of the invention.
Figure 8:
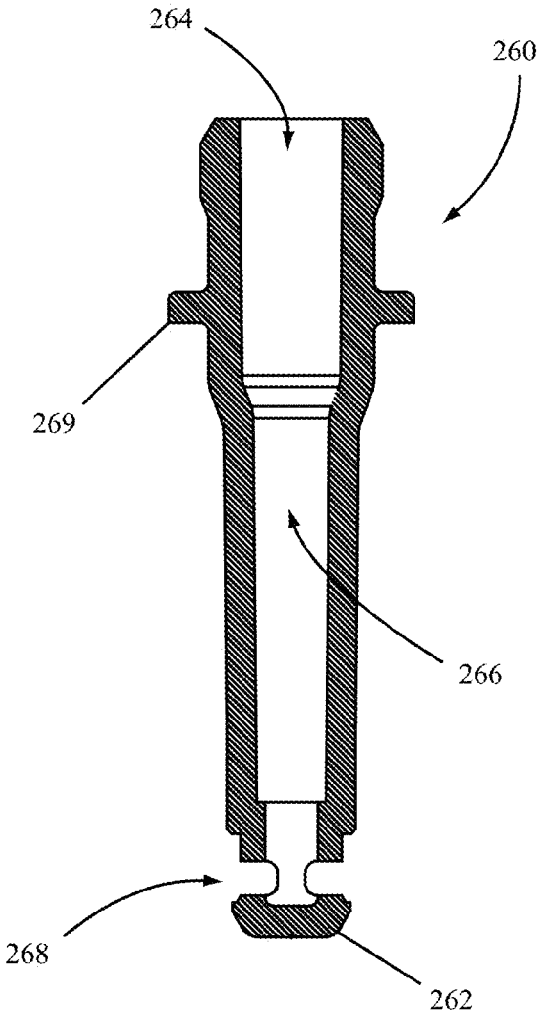
FIG. 8 illustrates a cross-sectional view of a piston stem according to various embodiments of the invention.

A piston stem 260 according to various embodiments of the invention may include a conventional piston stem 260 capable of mating with a piston seal 230 to form a piston of the pump engine 200. In some embodiments, a piston stem 260 may include a fluid lock 262 at one end of the piston stem 260 and an output opening 264 at an opposite end of the piston stem 260 as illustrated in FIGS. 7 and 8. The output opening 264 is connected to a piston fluid flow path 266 through an interior of the piston stem 260. One or more input openings 268 adjacent the fluid lock 262 provide openings through a wall of the piston stem 260 to the piston fluid flow path 266. In use, fluid may flow past the fluid lock 262, through the one or more input openings 268 into the piston fluid flow path 266, and out the output opening 264.

A piston stem 260 may also include one or more piston stem flanges 269 as illustrated in FIGS. 7 and 8. A piston stem flange 269 may extend outwardly off of an outer surface of a piston stem 260 wall. As illustrated, a piston stem flange 269 may include a circular ring extending outwardly from the main body or wall of the piston stem 260. In some embodiments, the piston stem flange 269 may be perpendicular to the wall of the piston stem 260. A piston stem flange 269 may be configured to mate with or secure a portion of a spring 290 there against. A piston stem flange 269 may also be configured to fit within an output cylinder 240 of a pump engine 200.

Figure 16:
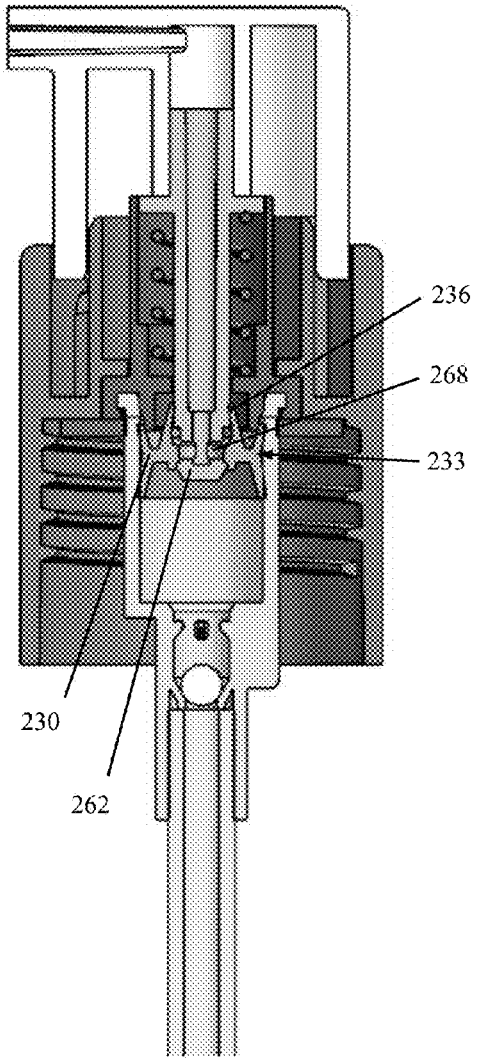
FIG. 16 illustrates a cross-sectional view of a pump engine according to various embodiments of the invention at rest.
Figure 17:
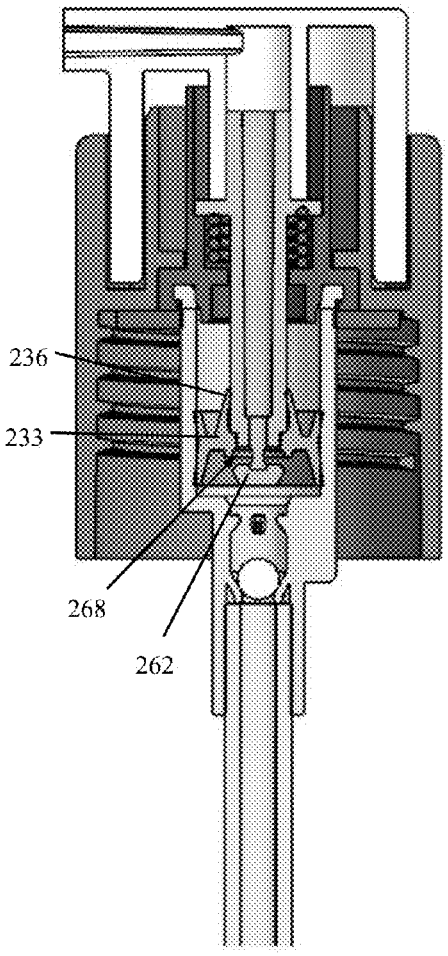
FIG. 17 illustrates a cross-sectional view of an actuated pump engine according to various embodiments of the invention.

According to various embodiments of the invention, the piston stem 260 is moveably connected to the piston seal 230 as illustrated in FIGS. 16 and 17. The piston seal 230 may fit around the end of the piston stem 260 adjacent the fluid lock 262 such that the fluid lock 262 may rest against a lower portion of the central portion 233 of the piston seal 230 body as illustrated in FIG. 16. The inner flange 236 of the piston seal 230 may rest against or seal against an outer wall of the piston stem 260 above the one or more input openings 268. In the rest position, the one or more input openings 268 may be sealed or closed by contact with the central portion 233 of the piston seal 230 body. Upon application of a force on the piston stem 260—such as by application of a force on the piston stem flange 269—towards the piston seal 230, the piston stem 260 may move relative to the piston seal 230 such that the one or more input openings 268 are opened below a lower portion of the central portion 233 of the piston seal 230 body as illustrated in FIG. 17. After a defined movement a portion of the piston stem 260 directly above the one or more openings 268 may engage with an upper surface of the central portion 233 of the piston seal 230, thereby applying a force to the piston seal 230 to move the piston seal 230 within a product chamber 214 of the accumulator 210. Upon release of the force on the piston stem 260—or application of a force in the opposite direction such as by spring 290—the piston stem 260 may move relative to the piston seal 230 to close or seal the one or more openings 268 against a portion of the central portion 233 of the piston seal 230. The fluid lock 262 may then engage a lower surface of the central portion 233 of the piston seal 230, preventing further flow of product into the one or more openings 268 and moving the piston seal 230 in an opposite direction in the product chamber 214 of the accumulator 210.

According to some embodiments of the invention, the movement of the fluid lock 262 relative to the piston seal 230 creates a vacuum within the product chamber 214. For example, as illustrated in FIG. 17, the fluid lock 262 is disengaged from the piston seal 230, allowing product to move from an interior of the product chamber 214 into one or more openings 268 for dispensing. Upon release of a force on the piston stem 260—or application of a force such as by spring 290—the piston stem 260 begins to rise which moves the fluid lock 262 towards the piston seal 230. As the fluid lock 262 moves within the product chamber 214, a vacuum is formed in the space or in the volume that the fluid lock 262 occupied within the product chamber 214. The formation of the vacuum as the fluid lock 262 moves towards the piston seal 230 causes product in the fluid flow path 266 to flow backwards through the one or more openings 268 and back into the product chamber 214. This backward flow results in product throughout the fluid flow path 226 and in the dispenser head 140 flowing backwards, which in turn sucks product back from the tip of the dispenser head 140. This suck-back feature results in a cleaner cut off of product from the pump system 100. Once the one or more openings 268 are closed by engagement with the piston seal 230, the suck-back may terminate and the product chamber 214 is filled as movement of the piston seal 230 creates a vacuum in the product chamber 214, drawing product into the product chamber 214 past valve 220.

According to various embodiments of the invention, a fluid lock 262 and positioning of the one or more openings 268 relative to the fluid lock 262 may be adjusted in combination with the configuration of a piston seal 230 relative to the fluid lock 262 such that a desired suck-back volume is accomplished. For instance, the shape and size of the fluid lock 262 extending into the product chamber 214 may be configured to create a vacuum or void space that pulls, draws-back, or sucks back a desired amount of product upon release of a force on the pump system. In this manner, the amount of product subject to the suck-back can be controlled or designed by altering the shape and size of the fluid lock 262 and the amount of time that the one or more openings 268 remain open on a return stroke following actuation of the pump system 100. For example, in some embodiments of the invention a suck-back volume of between about 6 μl and about 9 μl. In other embodiments of the invention, a suck-back volume of between about 7 μl and about 8.5 μl may be desirable.

As product is sucked-back during a return stroke of the pump system 100, product at the tip of the dispenser head 140 is pulled back into the dispenser head 140 and the fluid flow path therein. The suck-back feature is advantageous because it pulls product that would otherwise drip out of the end of the dispenser head 140 back into the pump system 100, possibly creating a cleaner dispensing experience for a user. In addition, retraction or suck-back of product into the dispenser head 140 may prevent product from drying out around the outlet of the dispenser head 140 and forming a crust at the tip, again, possibly providing a cleaner and better dispensing experience for a user.

Figure 9:
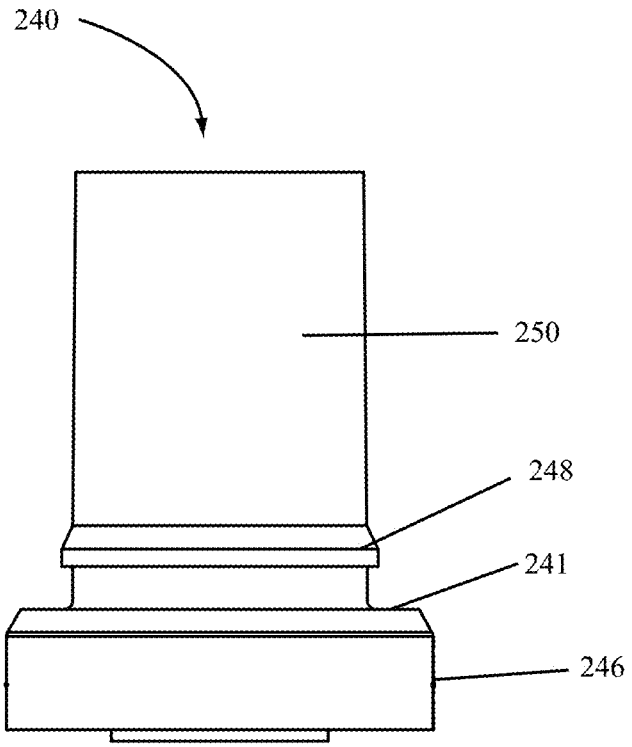
FIG. 9 illustrates an output cylinder according to various embodiments of the invention.
Figure 10:
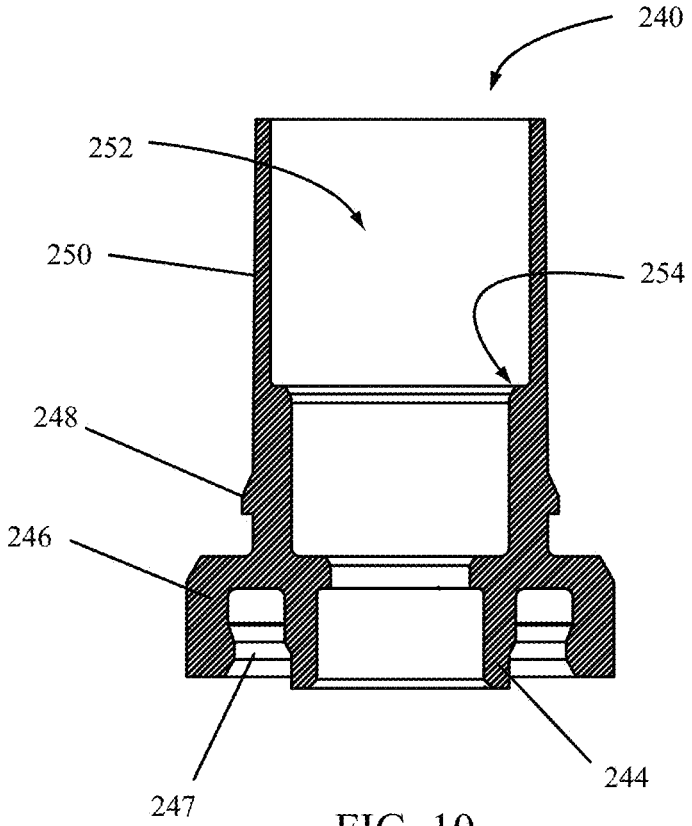
FIG. 10 illustrates a cross-sectional view of an output cylinder according to various embodiments of the invention.

An output cylinder 240 according to certain embodiments of the invention is illustrated in FIGS. 9 and 10. An output cylinder 240 may include a base wall 241 having a cylinder wall 250 projecting outward therefrom. As illustrated, the cylinder wall 250 may be perpendicular to, or substantially perpendicular to, the base wall 241. The cylinder wall 250 may be cylindrical in shape and defines a cavity 252 within the output cylinder 240. One or more output stops 254 may also be defined in the cylinder wall 250 or positioned within the cavity 252. As illustrated in FIG. 10, an output stop 254 according to some embodiments of the invention may be formed from a thicker portion of the cylinder wall 250. In other embodiments, an output stop 254 may include a projection off of the base wall 241 adjacent an interior surface of the cylinder wall 250. According to still other embodiments, an output stop 254 may include a projection extending off an interior portion of the cylinder wall 250 towards an interior of the cavity 252. According to various embodiments of the invention, an output stop 254 may follow an entire circumference of the interior surface of the cylinder wall 250. For example, in some embodiments a portion of the cylinder wall 250 adjacent the base wall 241 is thicker over a defined distance at which point a ledge is formed where the cylinder wall 250 becomes thinner as illustrated in FIG. 10. The difference in the thickness of the cylinder wall 250 forms a circular ledge within an interior of the cavity 252 which ledge acts as an output stop 254 according to various embodiments of the invention. In other embodiments, an output stop 254 may only be located adjacent a portion of the interior surface of the cylinder wall 250. For instance, one or more piers or projections may be included in the cavity 252 adjacent the cylinder wall 250 such that a top surface of each pier or projection is at a height where movement of a piston stem 260 within the output cylinder 240 may be halted.

According to various embodiments of the invention, an output stop 254 may be configured to stop movement of a piston stem 260 in a pump engine 200 configuration or in a pump system 100. As illustrated in FIGS. 1 and 11-13, a spring 290 may be positioned in the cavity 252 of the output cylinder 240 and may act on one end against a portion of the output cylinder 240, such as against a portion of the base wall 241 of the output cylinder 240 as illustrated. An opposite end of the spring 290 may act against a portion of the piston stem 260, such as against the piston stem flange 269. A piston stem 260 may be at least partially positioned in the cavity 252 of the output cylinder 240 such that the spring 290 is partially compressed, applying a force to the piston stem 260. Application of a force to the piston stem 260 at the piston stem flange 269 or adjacent the output opening 264 of the piston stem 260 may move the piston stem 260 towards the base wall 241 of the output cylinder 240 until the piston stem flange 269 is stopped by an output stop 254. Once the piston stem flange 269 engages an output stop 254, further movement of the piston stem 260 towards the base wall 241 is stopped, ceasing movement of the piston seal 230 in the accumulator 210 and flow of a product through the piston stem 260. Thus, the output stop 254 dictates or controls the length of the piston stroke and the amount of product that may be pumped through the pump engine 200 for any given full stroke of the piston stem 260.

Figure 11:
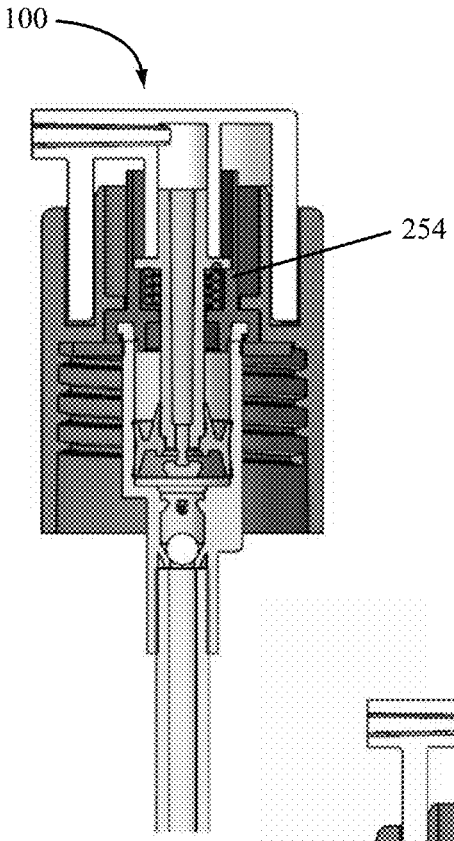
FIG. 11 illustrates a cross-sectional view of a pump system in operation according to various embodiments of the invention.
Figure 12:
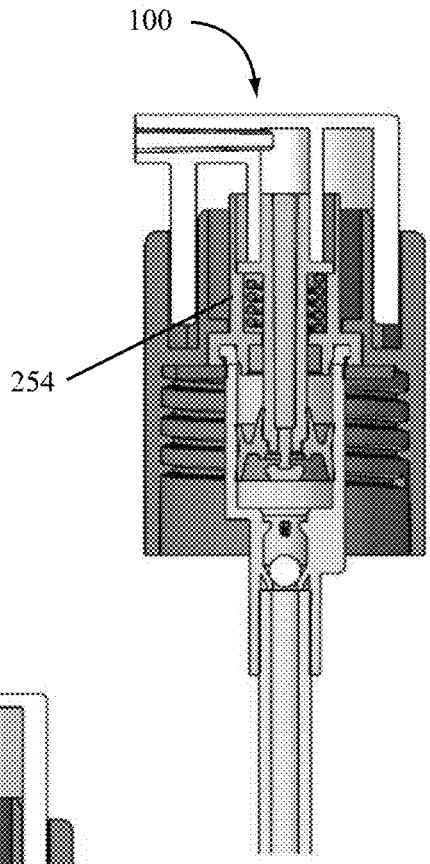
FIG. 12 illustrates a cross-sectional view of a pump system in operation according to various embodiments of the invention.
Figure 13:
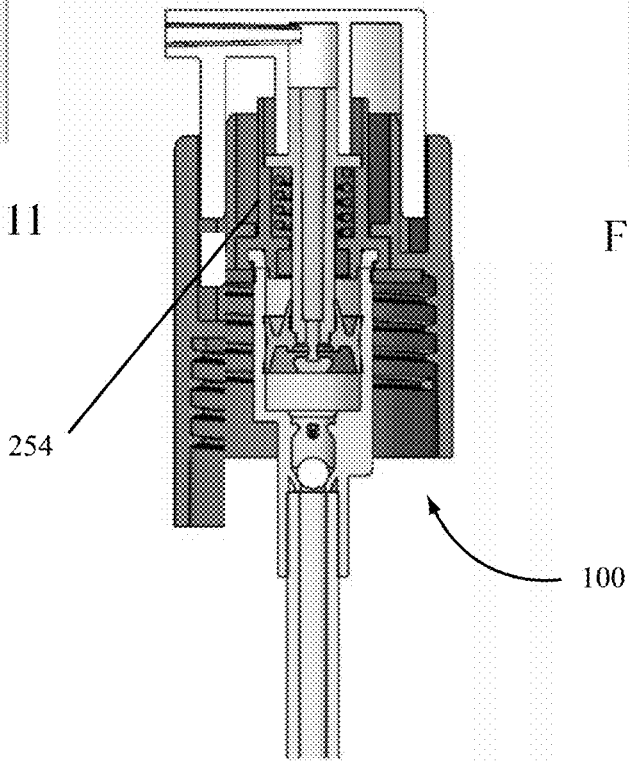
FIG. 13 illustrates a cross-sectional view of a pump system in operation according to various embodiments of the invention.
Figure 14:
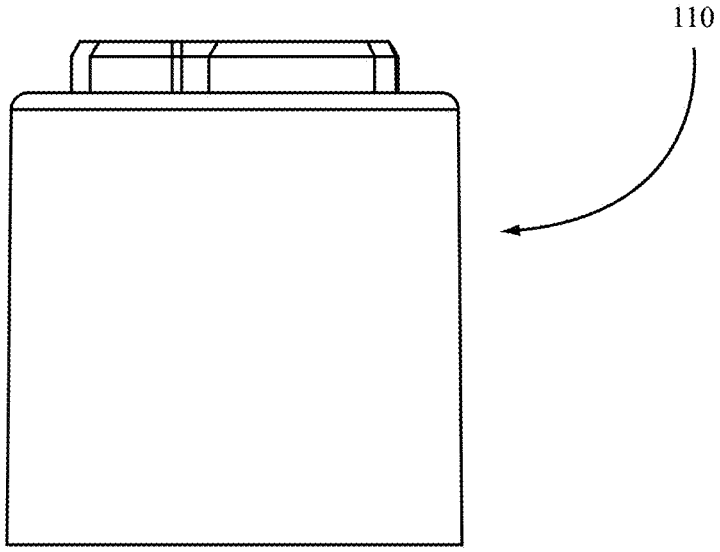
FIG. 14 illustrates a closure according to various embodiments of the invention.

According to various embodiments of the invention, the output of a pump engine 200 may be altered by changing the position of the output stop 254 within the output cylinder 240. Thus, one part of the pump engine 200 may be changed to alter the amount of product pumped from a pump engine 200: the output cylinder 240. A pump engine 200 may be assembled with any one of a plurality of output cylinders 240 having different output stop 254 locations to achieve a desired output for the pump engine 200. For example, as illustrated in FIG. 11, a first output cylinder 240 may include an output stop 254 at a first location to allow a total output per stroke of approximately 0.2 mL. An output cylinder 240 having an output stop 254 at a second location may only allow a total output per stroke of approximately 0.15 mL as illustrated in FIG. 12. An output cylinder 240 having an output stop 254 at a third location may only allow a total output per stroke of approximately 0.12 mL as illustrated in FIG. 13. Other configurations could also be used such that pump engines 200 having any number of outputs could be manufactured using almost all of the same components, the only difference being the selection of the output cylinder 240 with the desired output stop 254.

In some embodiments of the invention, the output cylinder 240 may be color coded to reflect the output that is achievable utilizing the output cylinder 240 in a pump engine 200 or pump system 100. For instance, a first output may be color coded red, a second output color coded blue, and a third output color coded yellow. On the manufacturing floor or at the manufacturing location, the color coding may allow operators to more easily identify the proper output cylinder 240 to be assembled for a given run of pump engines 200 or pump systems 100. Thus, if a pump engine 200 having a desired first output is required, an operator may load the output cylinders 240 color coded red into the assembly machine for that assembly run. Likewise, if a third output is desired for an assembly run, an operator could change the output cylinders 240 to those color coded yellow. Similarly, an operator working with the assembly of a pump system 100 with a desired first output would be able to select the appropriate pump engine 200 assemblies to use based on the color of the output cylinder 240 of the pump engine 200.

According to various embodiments of the invention, pump engines 200 having different outputs may be easily assembled from common components in the manufacturing environment. The ability to utilize the same accumulator 210, piston seal 230, piston stem 260, and spring 290 along with a custom output cylinder 240 to manufacture piston engines 200 having different outputs is advantageous in part because the common components may be run at higher cavitation rates, thereby reducing the cost of those parts. Furthermore, as in the example above, the only parts that need to be changed on an assembly line to vary the output of the final pump are the output cylinders 240. In addition, smaller runs for particular output pump systems 100 are justifiable because smaller tools capable of producing only the output cylinder 240 do not require the capital investment required for larger tooling. This flexibility also allows for different output options to be easily manufactured and assembled without the costs of capitalizing an entire line for a particular pump system 100.

Figure 15:
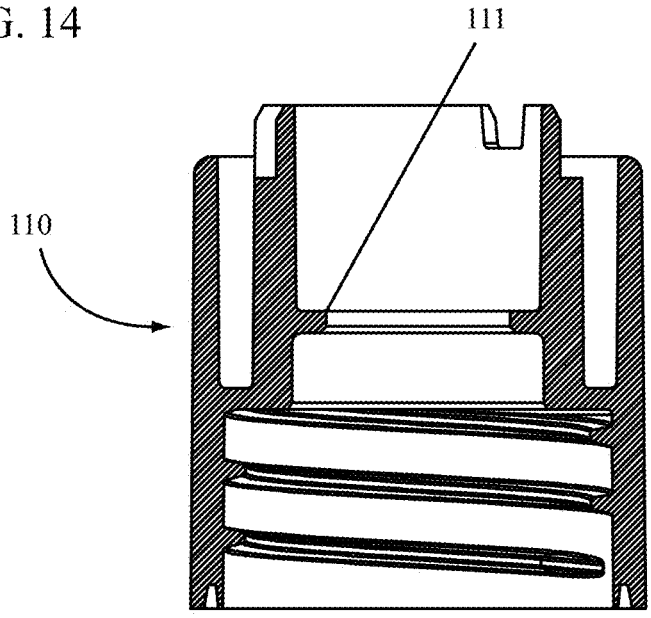
FIG. 15 illustrates a cross-sectional view of a closure according to various embodiments of the invention.

An output cylinder 240 according to various embodiments of the invention may also include one or more retaining flanges 248 about an exterior portion of the cylinder wall 250 as illustrated in FIGS. 9 and 10. A retaining flange 248 may be configured to help retain the output cylinder 240 in an assembled state with a closure 110 of a pump system 100. As illustrated in FIG. 15, a closure 110 may include a closure lip 111 projecting therefrom and configured to snap over the retaining flange 248 to retain the output cylinder 240 on the closure 110. In this manner, a pump engine 200 may be assembled to a closure 110 as part of the final pump system 100. A portion of the retaining flange 248 may be sloped to allow or facilitate assembly of the closure 110 to the output cylinder 240. For example, a pump engine 200 assembly may be assembled to a closure 110 by positioning the closure lip 111 over the retaining flange 248 of the output cylinder 240. Application of a force on the closure 110—or on the pump engine 200—may push the closure 110 and pump engine 200 together such that the closure lip 111 snaps over the retaining flange 248 and then retains the closure 110 and output cylinder 240 in an assembled state.

An output cylinder 240 according to various embodiments of the invention may also include a plug seal wall 244 extending off of the base wall 241 in a direction opposite that of the cylinder wall 250 as illustrated in FIG. 10. A plug seal wall 244 may be a cylindrical shape and may have a constant thickness or a tapering thickness. The plug seal wall 244 may seat against or seal against an inner surface of an accumulator 210. In some embodiments of the invention, the plug seal wall 244 may seal against the inner surface of the accumulator 210 such that minimal or no air or liquid may pass between the plug seal wall 244 and the accumulator 210. In such configuration, the pump engine 200 may be used with airless pump systems that do not require any venting. In those instances where a pump engine 200 or pump system 100 is to be used as an atmospheric-type pump, sealing between the plug seal wall 244 and the accumulator 210 is not as critical because air must pass between the two components to allow air into the container 900 of the pump system 100.

According to some embodiments of the invention, an output cylinder 240 may also include a latch wall 246 extending off of the base wall 241 in the same direction as the plug seal wall 244 as illustrated in FIGS. 9 and 10. The latch wall 246 may be a cylindrical shape and may have a constant thickness or a tapering thickness. The latch wall 246 may also include a retention lip 247 on an interior edge of the latch wall 246. As illustrated in FIG. 10, the retention lip 247 may be adjacent the end of the latch wall 246. The latch wall 246 may also have a diameter or circumference that is greater than that of the plug seal wall 244. In some embodiments of the invention, the latch wall 246 may be configured to accept a retaining ring 215 of an accumulator 210 in such a manner to retain the accumulator 210 and output cylinder 240 in an assembled state. For example, as part of a pump engine 200, an accumulator 210 may be snap-fit into the output cylinder 240 such that the retaining ring 215 of the accumulator 210 snaps into the space between the latch wall 246, bottom surface of the base wall 241, and the plug seal wall 244. A retention lip 247 may help to secure the retaining ring 215 and accumulator 210 to the output cylinder 240.

Some embodiments of the invention may be used with airless pump systems where no air is allowed back into a container 900 of the pump system 100. In such instances, the attachment or seal between the accumulator 210 and output cylinder 240 is such that no air can pass through the attachment. In other instances, an atmospheric pump system may be desired. In those cases, the output cylinder 240 may include one or more air paths or vent paths on an interior surface of the latch wall 246 and through the retention lip 247 such that air may pass through an interior of the output cylinder 240, around the accumulator 210 and output cylinder 240 connection, and into a container 900 to which a closure 110 is attached.

A spring 290 according to various embodiments of the invention may include any conventional spring used with pump engines or pump systems. In addition, leaf-springs, plastic springs, and other types of springs may be incorporated with various embodiments of the invention.

A head 140 according to various embodiments of the invention may include a conventional pump head 140 that may be snap-fit or otherwise connected to a closure 110 such that the head 140 is in fluid communication with the piston stem 260. In some embodiments of the invention, a fluid flow path may be defined in the head 140 and a portion of a feature in the head 140 defining the fluid flow path may fit over an end of the piston stem 260 adjacent the second opening 212. In some embodiments, a portion of the head 140 may rest on the piston stem flange 269 and may apply force to the piston stem 260 during actuation of the head 140 by a user.

In some embodiments of the invention, a head 140 may also include an orifice at an output end of the fluid flow path. An orifice cup, valve, seal, or other feature conventionally used with pumps and sprayers may be inserted into the orifice to control or define an output from the pump system 100.

In further embodiments of the invention, a head 140 and closure 110 may include mating features configured to provide a locking capability for a pump system 100. For example, an interior portion of the head 140 may include ribs extending inwardly and a closure 110 may include posts upon which those ribs may rest in a locked position—preventing movement of the head 140—and open areas in which the ribs may move during actuation without hinderance of the posts. Rotation of the head 140 may move the ribs into and out of a locked position or a position in which the ribs and posts align or do not align.

Conventional gaskets 190 may be used with various embodiments of the invention.

Conventional containers 900 may be used with various embodiments of the invention. In some embodiments, a container 900 may include a threaded closure system for mating with a closure 110 and in other embodiments a container 900 may include a snap-fit, bayonet, or permanent snap closure system allowing the container 900 and closure 110 to attach to each other.

A pump engine 200 according to certain embodiments of the invention may be assembled prior to assembly with a pump system 100. For example, in some embodiments of the invention, a pump engine 200 may be assembled in a first location and then shipped or transported to a second location for final assembly with at least some of the pump system 100 components. Assembly of a pump engine 200 according to certain embodiments of the invention involves the assembly of the components illustrated in FIGS. 1 and 2.

In some embodiments of the invention, a pump engine 200 may be assembled using the following method: a spring 290 may be inserted into an interior of the output cylinder 240; a piston stem 260 may be inserted through the output cylinder 240 to secure the spring between the output cylinder 240 and a piston stem flange 269 such that the fluid lock 262 of the piston stem 260 extends through an opening in the output cylinder 240; a piston seal 230 is press fit over the fluid lock 262 to connect the piston stem 260 to the piston seal 230; a ball 22 is inserted into an accumulator 210; and the accumulator 210 is snap-fit into the output cylinder 240. When the fluid lock 262 of the piston stem 260 is forced through the opening in the piston seal 230, it cannot be pulled back through the piston seal 230, thereby retaining the piston seal 230, output cylinder 240, spring 290, and piston stem 260 in an assembled state such that it may be fitted to and connected with an accumulator 210 having a valve 200 assembled therewith. The final assembly results in a pump engine 200 according to various embodiments of the invention.

In some embodiments of the invention, a pump system 100 may be assembled using the following method: a pump engine 200 may be snap-fit to a closure 110; a pump head 140 may be snap-fit onto the closure such that it is in fluid communication with the piston stem 260 of the pump engine 200; a dip tube 180 may be—optionally—assembled to the first opening 211 of the accumulator 210 of the pump engine 200; a gasket 190 may be assembled inside the closure 110; and the closure 110 may be attached to a container 900. Alternatively, the closure 110, head 140, and dip tube 180 may be assembled with the pump engine 200 and transported or shipped to a filling location where it may be assembled to a container 900 on, or as part of, a conventional fill line or filling process.

While various embodiments of the invention have been described with respect to a pump or pump dispenser, it is understood that a pump engine 200 or output cylinder 240 according to embodiments of the invention could be incorporated into a fine-mist sprayer, trigger sprayer, or other device to provide optional outputs for such devices.

While various embodiments of the invention are described herein, it is understood that the particular embodiments defined by the appended claims are not to be limited by particular details set forth in the description, as many apparent variations thereof are contemplated. Rather, embodiments of the invention are limited only by the appended claims, which include within their scope all equivalent devices or methods which operate according to the principles of the embodiments of the invention described.

What is claimed is:

1. A pump system, comprising:

a closure;

a pump engine attached to the closure, the pump engine comprising:

an accumulator having a product chamber;

an output cylinder defining a cavity therein, the accumulator removably attached to the output cylinder by interfitting snap-fit latch structures, said output cylinder further comprising a base wall, a cylindrical wall extending off of the base wall, the cylindrical wall defining the cavity, a plug seal wall extending off of the base wall in a direction opposite the cylindrical wall, and a latch wall extending off of the base wall in the same direction as the plug seal wall;

an output stop within the cavity, said output stop being arranged to define an output volume;

a piston stem comprising a fluid lock at one end extending through the cavity and into the product chamber;

a piston stem flange extending off of a portion of the exterior surface of the piston stem within the cavity, said piston stem flange engaging with said output stop to generate said output volume; and a piston seal in the product chamber and attached to the piston stem;

a head moveably attached to the closure and attached to an end of the piston stem;

a container attached to the closure, wherein at least a portion of the pump engine is positioned in an interior of the container; and wherein application of an actuation force on the pump engine moves the fluid lock into the product chamber and exposes at least one input opening in the fluid stem to product in the product chamber allowing fluid to flow through the at least one input opening and release of the actuation force moves the fluid lock back to a rest position out of the product in the product chamber, creating a vacuum within the pump chamber and drawing product back into the product chamber through the at least one input opening.

2. The pump system of claim 1, wherein the piston stem is moveable within the cavity and product chamber.

3. The pump system of claim 1, wherein the output cylinder comprises a material made of a colored resin.

4. The pump system of claim 1, wherein the accumulator further comprises a retaining ring and the retaining ring is snap-fit between the plug seal wall and latch wall, attaching the accumulator to the output cylinder.

5. The pump system of claim 4, wherein the at least one output stop within the cavity comprises a junction between a first portion of the cylindrical wall and a second portion of the cylindrical wall, the first portion of the cylindrical wall being thicker than the second portion of the cylindrical wall.

6. The pump system of claim 5, further comprising a second output cylinder, comprising:

a base wall;

a cylindrical wall extending off of the base wall and defining a cavity;

an output stop within the cavity, said output stop being arranged to define a second output volume;

a plug seal wall extending off of the base wall in a direction opposite the cylindrical wall;

a latch wall extending off of the base wall in the same direction as the plug seal wall, the latch wall being receivable in snap-fit engagement with the retaining ring of the accumulator, said piston stem flange engaging with said output stop to generate said second output volume, wherein said output cylinder and said second output cylinder are interchangeably receivable in snap-fit engagement with the accumulator.

7. The pump system of claim 6, wherein the output cylinders are made of different colored resins to identify respective output volume when assembled.

* * * * *